US007468703B1

(12) United States Patent
Gerhard

(10) Patent No.: US 7,468,703 B1
(45) Date of Patent: Dec. 23, 2008

(54) BUOYANT CABLE ANTENNA SYSTEM

(75) Inventor: Erich M. Gerhard, deceased, late of South Kingstown RI (US); by Heidi R. Pickreign, legal representative, Harvard, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 20 days.

(21) Appl. No.: 11/650,761

(22) Filed: Dec. 26, 2006

(51) Int. Cl.
*H01Q 1/34* (2006.01)
*H01Q 1/04* (2006.01)

(52) U.S. Cl. ..... 343/709; 343/719

(58) Field of Classification Search ..... 343/709, 343/719, 878, 880, 881, 888
See application file for complete search history.

(56) References Cited

U.S. PATENT DOCUMENTS 2,428,480 A 10/1947 Tunstall
3,117,596 A 1/1964 Kahn
3,599,213 A * 8/1971 Fessenden et al. ..... 343/710
3,823,249 A 7/1974 Floessel et al.
4,346,953 A 8/1982 Carnaghan et al.
5,272,486 A * 12/1993 Dickinson ..... 343/719
5,517,202 A * 5/1996 Patel et al. ..... 343/709
5,561,640 A 10/1996 Maciejewski
5,745,436 A 4/1998 Bittleston
5,933,117 A * 8/1999 Gerhard ..... 343/709
6,870,508 B1 * 3/2005 Rivera ..... 343/709

* cited by examiner

*Primary Examiner*—Hoang V Nguyen
(74) *Attorney, Agent, or Firm*—James M. Kasischke; Jean-Paul A. Nasser; Michael P. Stanley

(57) ABSTRACT

A buoyant cable system and method is provided with a flexible towed platform that may be deployed into the water from a submerged submarine. The flexible towed platform has a memory that returns to a selected shape after deployment. A presently preferred selected shape may have one or more curves that provide a function during towing. For instance, in one embodiment two oppositely extending curves each float and each are pressed by the water in a balanced manner to provide a stable platform for one or more antennas which can be of different types suitable for a wide band of radio frequency reception/transmission. In another embodiment, a keel may be formed from a weighted curved portion that is suitable for vertically supporting an antenna. The flexible towed material may be constructed of coil springs, shaped memory alloys, and the like.

16 Claims, 4 Drawing Sheets

SERPENTINE

BUOYANT CABLE ANTENNA SYSTEM

STATEMENT OF THE GOVERNMENT INTEREST

The invention described herein may be manufactured and used by or for the Government of the United States of America for Governmental purposes without the payment of any royalties thereon or therefore.

CROSS REFERENCE TO RELATED PATENT APPLICATION

The instant application is related to three co-pending U.S. patent applications entitled BUOYANT CABLE ANTENNA SYSTEM AND METHOD WITH ARTICULATING BLOCKS (Navy Case No. 80224), BUOYANT CABLE ANTENNA CONFIGURATION AND SYSTEM (Navy Case No. 80225), and SERPENTINE BUOYANT CABLE ANTENNA SYSTEM (Navy Case No. 80226), having the same filing date.

BACKGROUND OF THE INVENTION (1) Field of the Invention

The present invention relates generally to a flexible antenna system and, in a more particular preferred embodiment, to a buoyant cable antenna system with extended frequency range capability.

(2) Description of the Prior Art

Buoyant cable antennas are well known for use by submarines when the submarine is submerged. Such cables have been used to receive radio signals in the very low frequency and low frequency (VLF/LF) transmission bands. For instance, present buoyant cable antenna systems consist of a horizontal wire antenna for reception of signals in the range of from about 10 kHz to 130 kHz.

The buoyant cable antenna floats on the ocean surface and is deployed with a buoyant cable. The horizontal antenna element lies on the surface of the ocean and reception is limited by transmission line attenuation, amplifier gain and antenna characteristics. Seawater attenuation, antenna gain and frequency patterns limit the usefulness of the horizontal antenna element.

The buoyant cable antenna must be flexible because a submerged submarine preferably launches the cable antenna through a transfer mechanism which bends the cable through a six-inch radius. Because flexibility is required, buoyant cable antennas have employed a horizontal wire antenna element which receives signals from the fore and aft (front and back) direction relative to its deployment. The limited antenna gain pattern limits the reception capability of the buoyant cable antenna.

Various inventors have addressed similar problems related to buoyant cable antennas as discussed in the following patents. U.S. Pat. No. 5,933,117, issued Aug. 3, 1999, to the present inventor Erich M. Gerhard, is incorporated herein by reference, and discloses a buoyant loop antenna, deployable along a cable, which includes a core region comprising a plurality of annular ferrite beads. These annular shaped beads include a center hole and a generally concave first end and a generally convex second end. The ferrite beads are aligned with the concave end of one bead against the convex end of another bead. This allows the cable to flex while the beads maintain contact with each other, providing flexibility and resistance to crushing. The core region has a loop wire wrapped helically around it, forming the loop antenna. The loop wire element starts and ends at the same end of the core region, forming a loop. This loop allows transmission and reception in an athwart (side to side) direction. This wire loop antenna can be combined with a straight wire antenna (which provides reception in a fore and aft direction) to provide an omni-directional cable antenna assembly for VLF/LF frequency ranges.

U.S. Pat. No. 1,667,510, issued Apr. 24, 1928, to J. R. Coe, discloses a cable constituting an electrical conductor for high tension transmission lines having, in combination, a core comprising a plurality of short rigid members arranged end to end, and contacting wires of high electrical conductivity arranged spirally and side by side about said members.

U.S. Pat. No. 1,810,079, issued Jun. 16, 1931, to H. C. Jennison, discloses a conducting cable comprising a series of cups constituting a supporting means comprising a plurality of diaphragms and round contacting conductors spirally wound about the supporting means. The several cups have on their sides longitudinally extending surfaces aligning the cups within the spirally wound conductors. Adjacent end portions of adjacent cups are suitably nested so as to form ball and socket, joints between them.

U.S. Pat. No. 2,419,053, issued Jul. 3, 1942, to C. E. Bennett, discloses an electric cable in which the weight to volume ratio is such to render the cable buoyant. The cable comprises a continuous water pervious tubular member, conductor strands laid up about the tubular member or core, and a sheath of insulating material about the conductor strands. Floats are threaded upon the sheath and rigidly secured thereto. The adjacent ends of the floats are telescoping with each other while permitting relative angular movement to provide a flexible structure.

U.S. Pat. No. 4,978,966, issued Dec. 18, 1990, to Takizawa et al., discloses an antenna with a plurality of rod-shaped cores aligned in an end-to-end relationship and an antenna coil wound on the core array throughout its entire length. This arrangement permits the antenna to bend and fit a curved surface of a car where the antenna is mounted.

U.S. Pat. No. 2,428,480, issued Oct. 7, 1947, to H. A. Tunstall, discloses a tubular buoyancy element comprising a longitudinally flexible helix resistant to radial compression and a flexible waterproof covering enclosing the helix. Means comprising expanded rubber plugs are provided within the covering and have peripheral surfaces molded to and closely fitting the internal surface thereof for dividing the interior of the element into a plurality of closed compartments.

U.S. Pat. No. 3,117,596, issued Jan. 14, 1964, discloses a buoyant flexible hose comprising helically wound reinforcement means comprising a pair of tubular members in laterally adjacent relation and having longitudinally spaced convolutions and a plastic carcass enclosing at least a portion of the reinforcement means. The carcass comprises an inner tubular wall portion and an outer helically corrugated wall portion having the valley portions thereof secured to opposed portions of said inner wall portion. A portion of the reinforcement means is disposed between the peak portions of the corrugated outer wall portion and opposed portions of the inner wall portion. Sealed helical air spaces are formed between the portion of the reinforcement means and opposed surface portions of the carcass wall portions enclosing the same. The sealed air spaces are disposed on either side of the portion of the reinforcement means.

U.S. Pat. No. 3,823,249, issued Jul. 9, 1974, to Floessel et al., discloses a compressed gas insulated electrical high voltage conductor assembly comprised of a number of pressurized gas filled rigid straight sections arranged in end to end relation. Each section is constituted by a length of a rigid metallic tubular member which encloses and supports centrally therein a rigid portion of the electrical conductor. These rigid conductor enclosing section are joined together by means of short flexible sections of the tubular enclosing member and a corresponding flexible portion of the conductor thereby to enable the connected together rigid sections to be bent through an angle of substantially 180 degrees to facilitate transport from the fabrication point to a remote location for on site installation.

U.S. Pat. No. 5,561,640, issued Oct. 1, 1996, to W. C. Maciejewski, discloses a sonar array cable typically provided in lengths comprising hydrophone arrays and associated electronics and transmitter can components, with each cable length or section having one of each of these components housed therein. These sections are relatively stiff and unbendable, requiring that they be connected with relatively bendable intermediate segments. These intermediate segments are susceptible to excessive bending that can lead to failure of the wiring provided therebetween. The wiring in these intermediate bendable segments is provided in the form of a coil, each coil is rigidly connected to the transmitter and electronics in one cable section, and the other end of the coil being connected electrically to the wiring associated with the hydrophone array in an adjacent cable section. Each coil is encased in relatively soft urethane material, preferably in one portion of the bendable segment, another portion of the bendable segment having the coil connected at its other end to a relatively still urethane material associated with the transmitter can and associated electronics.

U.S. Pat. No. 4,346,953, issued Aug. 31, 1982, to Carnaghan et al., discloses a flexible coupling assembly for a radio antenna of a submarine buoyant cable antenna system is connected in a cable line that retains the characteristics of the cable as regards the outside diameter, flexibility tensile strength and electrical continuity. The assembly comprises flexible co-axial connectors at each end keyed to an insulator that press fit in a transition piece. The transition piece is press fit into the tubing by barbed type annular rings machined into the transition piece. Between the insulators and enclosed by the tubing are plastic pieces connected by a coil spring.

U.S. Pat. No. 5,745,436, issued Apr. 28, 1998, to S. H. Bittleston, discloses a semi-dry marine seismic streamer cable that consists of a number of connected streamer cable sections which each comprise a mechanical jacket surrounding a hollow core enclosing the seismic sensor and signal transfer means. Elongated axial stress elements for transmitting axial loads and a radial reinforcement member for relieving radial loads are provided in the jacket. The core is filled with a fluid or fluid saturated foam and the sensor means are mounted in the core by vibration isolating elements.

The above cited prior art discloses buoyant antenna cables which, at best, are limited in frequency range and which are limited as to the types of antennas which can be used therewith. Those skilled in the art will appreciate the present invention that addresses the above and other problems.

SUMMARY OF THE INVENTION

Accordingly, it is an object of the present invention to provide an improved buoyant cable system.

It is another object of the present invention to use a coil form to provide a suitable shape for a platform that is flexible for deployment purposes.

It is yet another object of the present invention to provide an improved towed platform for supporting one or more antennas having a wide frequency response.

It is yet another object of the present invention to provide an improved platform with one or more curves that provide support in the water.

These and other objects, features, and advantages of the present invention will become apparent from the drawings, the descriptions given herein, and the appended claims.

In accordance with the present invention, a buoyant, flexible antenna system is operable for use in water with a transmission line. The system comprises elements such as, for instance, at least one linear platform for towing in the water with the transmission line. The linear platform may have a selected shape with one or more curved sections that extend outwardly away from a theoretical centerline of the at least one linear platform. The linear platform may be comprised of a flexible construction and may preferably have a memory of a selected shape. The flexible construction may be operable for flexing during a deployment into the water and for returning to the selected shape after the deployment into the water. In a preferred embodiment, one or more antennas are mounted to the at least one linear platform.

In one embodiment, a rotary connector is used between the at least one linear platform and the transmission line. For instance, a weight may be mounted to the one or more curved portions such that when separated from the transmission line with a rotary connector, the weighted curved portion acts as a keel for supporting the antenna in a desired position. The weight may be mounted at an apex of the curved portion.

In another embodiment, the linear platform may comprise a first curved section and a second curved section such that the first curved section and the second curved section extend outwardly from the theoretical centerline in opposite directions.

In one presently-preferred embodiment, the one or more curved portions further comprise a spring form.

A method for a buoyant cable system in accord with the present invention may comprise steps such as, for instance, providing a flexible linear construction for attachment to a transmission line wherein the flexible construction and the transmission line may be deployable into water. The flexible linear construction may have memory of a selected shape. Other steps may include mounting an antenna with respect to the flexible linear construction. Moreover the method may comprise steps such as providing that the selected shape has one or more curves therein and/or providing a curved shape to form a keel for supporting the antenna. In one embodiment, steps may include forming the flexible linear construction with a spring coil. In another embodiment steps may include forming the flexible linear construction with one or more shaped memory alloy wires. In this embodiment additional steps may include heating the one or more wires after deployment to return to the selected shape.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout several views of the drawings and wherein.

DESCRIPTION OF THE PREFERRED EMBODIMENTS

The present invention utilizes a curved buoyant cable antenna that can be deployed by a submerged submarine. The present invention can be used to provide extended frequency range capability to a buoyant cable antenna system. Besides increased frequency band reception, the antenna provides improved frequency gain and pattern enhancements. The flexible shape permits passage through deployment mechanisms. A construction is provided that is flexible but yet has memory to remember the desired shape after deployment.

Figure 1:
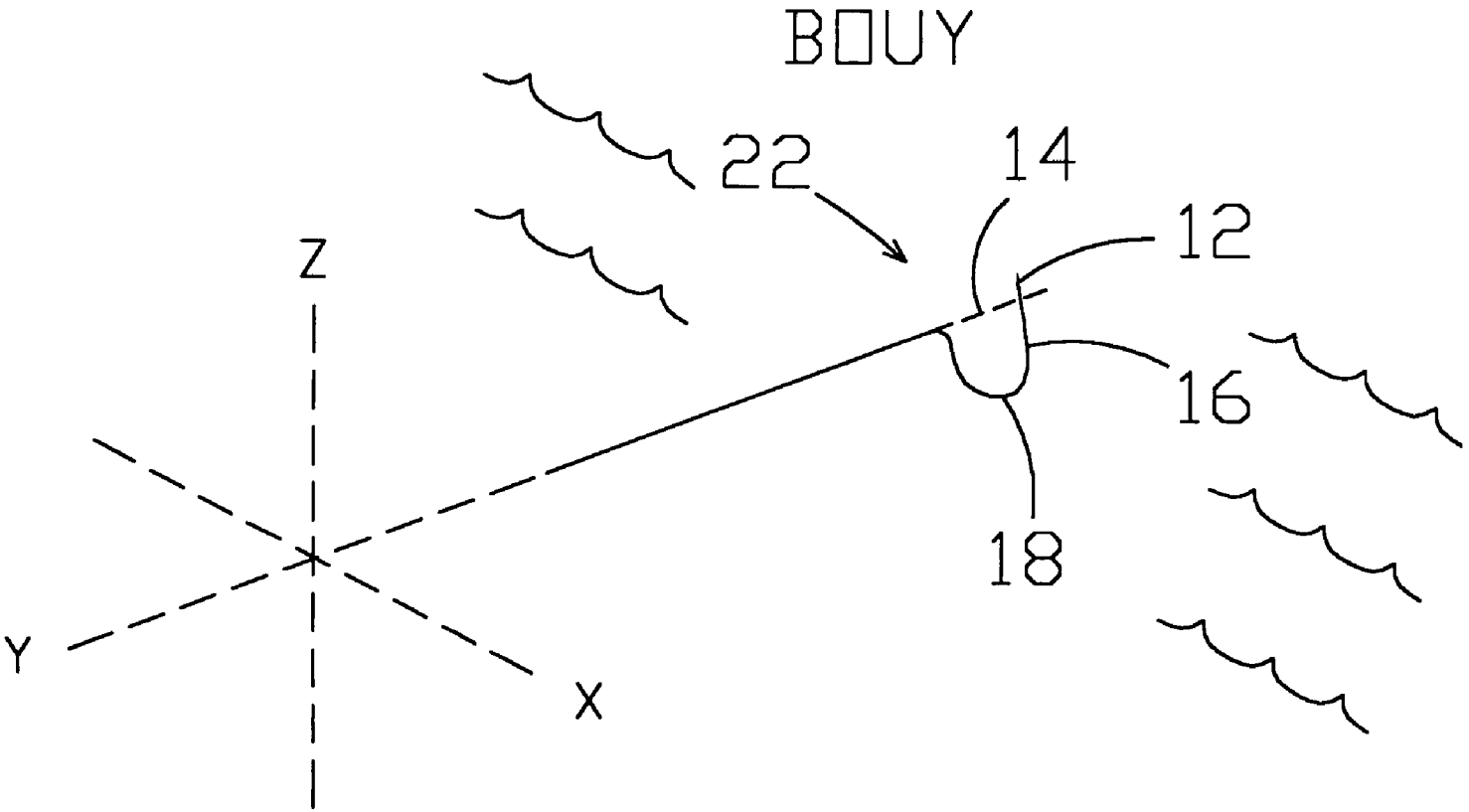
FIG. 1 is a schematic diagram of one embodiment of a curved cable antenna in accord with the present invention.
Figure 2:
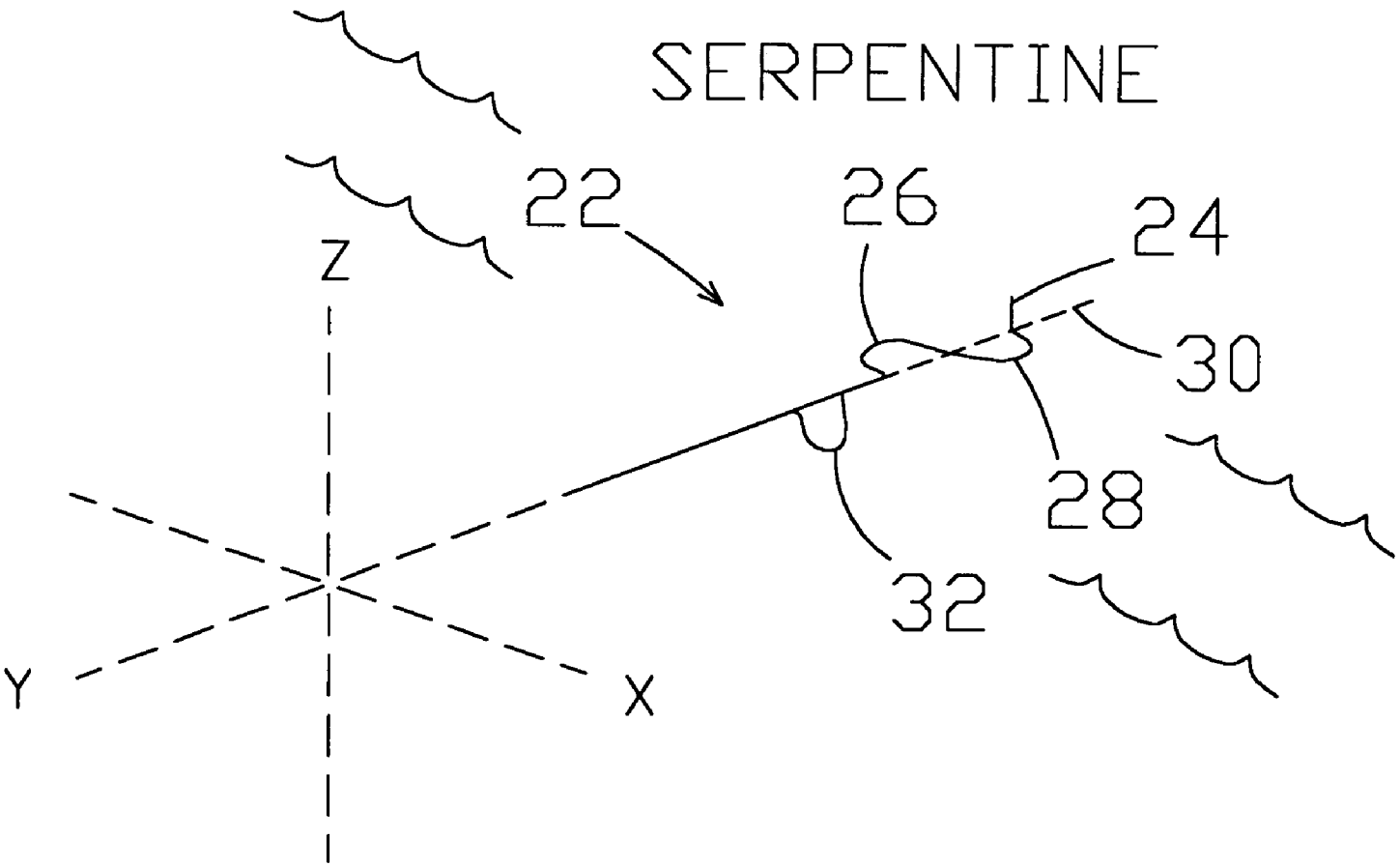
FIG. 2 is a schematic diagram of another embodiment of a curved cable antenna in accord with the present invention.

Referring now to the drawings, and more particularly to FIG. 1 and FIG. 2, there is shown two possible embodiments of desirable antenna structures that form towed buoyant platforms 10 and 10A, respectively, in accord with the present invention. Other shapes and constructions may also be used that avoid the problems of a horizontal wire antenna although the present invention can also be utilized in conjunction with a horizontal wire antenna.

Figure 3:
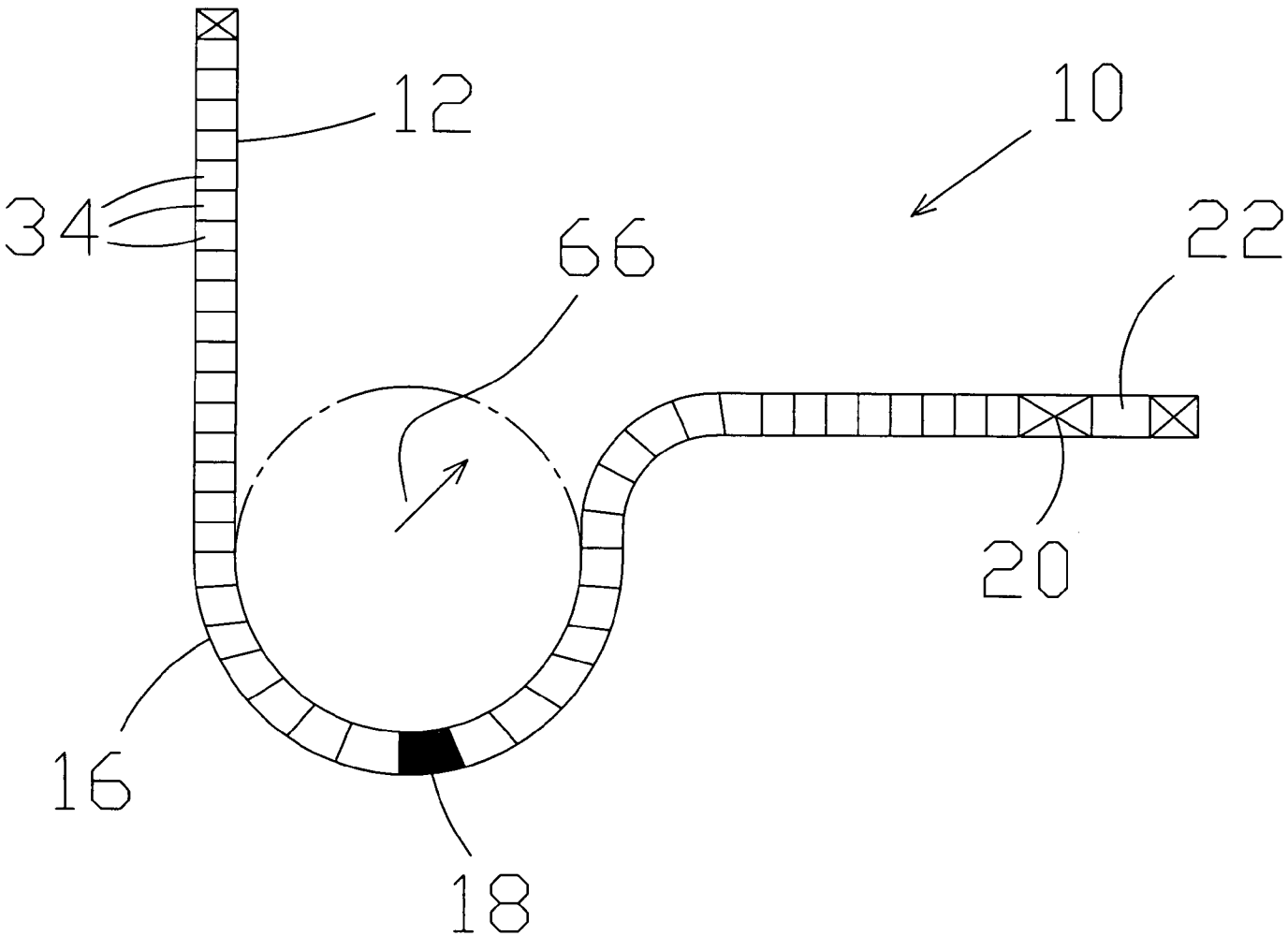
FIG. 3 is a diagrammatic view of a curved antenna comprised of a spring coil form in accord with the present invention.

In FIG. 1 and FIG. 3, towed platform 10 provides what may be referred to as a buoy construction whereby a portion of the antenna, such as portion 12, may actually, if desired, protrude above the water line, or vertically stand above the water line, which may typically be coincident or approximately coincident with the tow line or centerline 14. In this way, the transmitting/receiving portion may be sufficiently higher than the water line to avoid transmission/reception problems caused by water washing over the transmission line and/or may be properly positioned for transmitting the desired types of radio wave signals, e.g., vertically polarized signals. However, platform 10 may also be buoyantly designed to remain at or near the surface of the water without extending above the water, if desired. Towed platform 10 provides a keel portion 16 that may be curved to place keel portion 16 below the water surface to thereby provide a net upward buoyant force that positions portion 12 above the water surface, if desired. For this purpose, keel portion 16 may be substantially U-shaped or at least be formed in a curved shape. The water surface line is also typically the theoretical centerline for towed platform 10 from which curved or other shaped portions, such as keel portion 16, extend outwardly.

In one embodiment, keel portion 16 is weighted 19 at apex 18 to effectively provide a weighted keel that provides for vertical stability to section 12. The weight 19 may be external as depicted or internal to the platform 10 at the apex 18. Thus section 12 may provide for a vertical antenna. Section 12 thereby remains in an operational upright position. Rotary joint 20 may be used to permit rotation of keel portion 16 with respect to transmission line 22 to thereby permit upright positioning and avoid the towing effects that might rotate or twist transmission line 22.

Section 12 could be comprised of many different types of antenna constructions. Some antennas suitable for placement at section 12 might include monopole antennas, dipole antennas, helical antennas, spiral antennas, patch antennas, and the like. Such antennas are well known to have a wide range of frequency capabilities and can be designed for many frequency gain patterns. Thus, the present invention may be used to thereby utilize a wide range of different types of antennas only a few of which have been mentioned. The antenna may be mounted only at section 12 or may be mounted anywhere along towed platform 10 and may be used in conjunction with a horizontal wire type antenna mounted to transmission line 22. Moreover, multiple antennas may be mounted to towed platform 10, at the same or at various positions, if desired.

Figure 4:
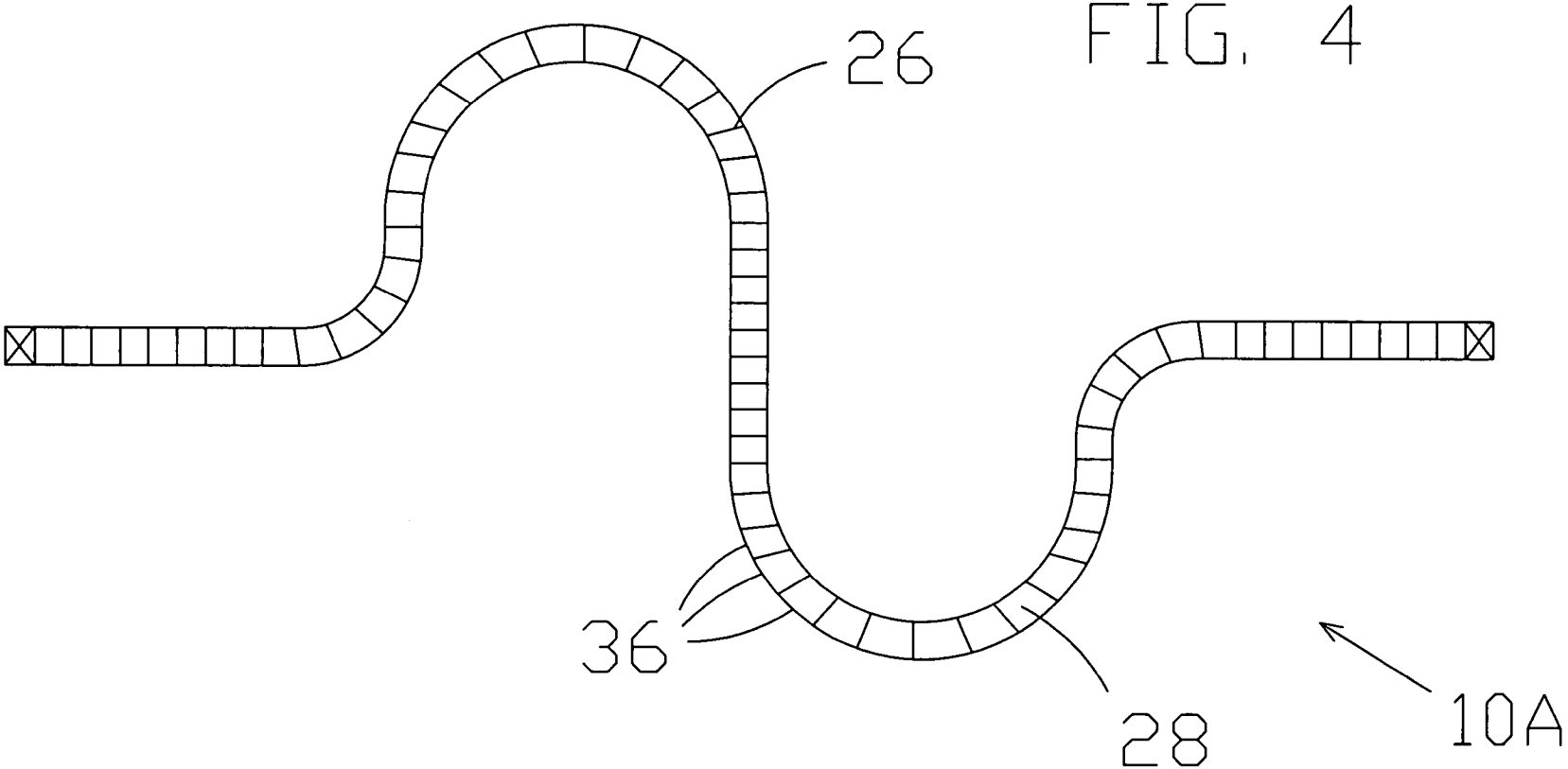
FIG. 4 is a diagrammatic view of another embodiment of a curved antenna comprised of a spring coil form in accord with the present invention.

Referring to FIG. 2 and FIG. 4, the serpentine shape of towed platform 10A also provides a stable support for a vertical antenna section 24 which may also extend out of water line, if desired. Towed platform has two curves 26 and 28, both of which are buoyant to thereby float near or on water surface 30. First curve 26 thereby counterbalances second curve 28 so as to support vertical antenna section 24, if used, in a vertical position during towing. Towed platform 10A may or may not include a keel section 32 which may be weighted 19 for even more stability.

FIG. 3 and FIG. 4 disclose one embodiment of the present invention that comprises spring material that provides a flexible structure with memory. Thus, coil 34 or coil 36 may comprise a spring with a controlled spring constant. The spring may be shaped during construction to a specific form such as that shown in FIG. 1-FIG. 4, or in any other desired form. Yet spring or coil 34, 36 is also sufficiently flexible to be moveable through a deployment mechanism used by a submarine for deploying such cables. The spring should be sufficiently strong to maintain the desired shape during towing but should be limited in compression to permit sufficient flexibility for deployment and retrieval. For example, such sufficiency of flexibility may permit coiling with a spooling radius 66, FIG. 3.

In another embodiment as could be illustrated in FIG. 1 and FIG. 2, the present invention may utilize one or more wires such as shaped memory alloys. For instance, Nitinol is comprised of nickel and titanium. When cool, one or more strands of such material may be bent and deployed as desired from the submarine deployment mechanism. When heated, such as by passing electric current therethrough, the material returns to the selected shape, which may selectable to be like the curved shapes shown in FIG. 1 and FIG. 2. The yield strength with which the material tries to return to the remembered shaped is considerable and may be in the range of about 35,000 to 70,000 psi. The electrical resistance of Nitinol is rather high and may be in the range of about 1.25 ohms per inch for 60 mil wire. Thus, the wire can be easily heated, for instance, by selectively passing a D.C. current therethrough. The diameter and number of strands of wire can be adjusted to provide suitable force to return to the learned shape. When left to cool after heating, the wire may be biased by the flow of water as is desired to return to a flexible shape to be pulled back into the submarine. The biasing provides that the wire will be able to return many times to the desired selected shape.

While curves have been shown which extend from centerline 14, other shapes which may include square, triangular, rectangular, or other forms may be used besides curved lines, although curved lines are easily formed in accord with the present invention.

Various means such as lightweight blocks, foam covers, and/or other floating support elements may be built into transmission line 12 to provide buoyancy of the transmission line. As well, horizontal fins and/or weighted fins may be utilized to lift the cable to a desired position and/or control the position of the cable in the water.

In summary, means are provided to provide a flexible cable construction that also has memory to assume a desired shape during towing. The desired shape may typically be related to a stable platform which may be used to support various types of antennas as desired.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A flexible antenna system operable for use in water with a transmission line, said system comprising:

at least one linear platform for towing in said water with said transmission line, said at least one linear platform having a selected shape with at least one section that extends outwardly away from a theoretical centerline of said at least one linear platform, said at least one linear platform being comprised of a flexible construction having a memory of said selected shape, said flexible construction being operable for flexing during a deployment into said water and having said memory for returning to said selected shape after said deployment into said water;

at least one antenna mounted to said at least one linear platform;

a weight mounted to a curved portion of said at least one linear platform; and at least one buoyant portion of said transmission line being buoyant in water with respect to said weight whereby said curved portion sinks in said water with respect to said at least one buoyant portion.

2. The system of claim 1, further comprising:

a rotary connector connecting said at least one linear platform to said transmission line.

3. The system of claim 1, further comprising:

said weight being mounted at an apex of said curved portion.

4. The system of claim 1, wherein said at least one section that extends outwardly further comprises a first curved section and a second curved section such that said first curved section and said second curved section extend outwardly from said theoretical centerline in opposite directions.

5. The system of claim 1, wherein said at least one section that extends outwardly further comprise a spring form.

6. A method for a cable system, said method comprising the steps of:

providing a flexible linear construction for attachment to a transmission line, said flexible construction and said transmission line being deployable into water, said flexible linear construction having memory of a selected shape;

mounting an antenna with respect to said flexible linear construction;

providing that said selected shape has at least one curve therein;

providing a curved shape to form a keel for supporting said antenna;

providing at least one buoyant portion of said transmission line; and stabilizing said keel with a weight.

7. The method of claim 6, further comprising the step of providing two opposing curves to form a platform for supporting said antenna.

8. The method of claim 6, further comprising the step of forming said flexible linear construction with a spring coil.

9. The method of claim 6, further comprising forming said flexible linear construction with at least one shaped memory alloy wire.

10. The method of claim 9, further comprising the step of heating said at least one shaped memory alloy wire after deployment to return said at least one shaped memory alloy wire to said selected shape.

11. The method of claim 6, further comprising the step of forming said at least one shaped memory alloy wire into at least one curved section.

12. A flexible antenna system operable for use in water with a transmission line, said system comprising:

a flexible linear construction having a selected shape with at least one curve, said flexible linear construction being sized for deployment underwater with said transmission line into said water, said flexible linear construction comprising at least one buoyant portion;

at least one antenna supported on said flexible linear construction; and wherein said selected shape further comprises two opposing curves.

13. The system of claim 12, further comprising:

said flexible linear construction being comprised of a spring coil.

14. The system of claim 12, further comprising said flexible linear construction being formed of shaped memory alloy material.

15. The system of claim 12, wherein said selected shape further comprises a weighted keel formed from a curved portion of said flexible linear construction.

16. The system of claim 12, wherein said flexible linear construction further comprises:

a spring coil made of a material which is actuable to return to its selected shape by raising said spring coil to a temperature through the passing of current therethrough; and a source of electrical current which selectively passes current through the spring coil.

* * * * *